United States Patent [19]

Korb et al.

[11] 4,195,450

[45] Apr. 1, 1980

[54] PROCESS FOR TREATING SURFACES BY MEANS OF A JET OF LIQUID

[76] Inventors: Josef Korb, Teitscheiderweg 5; Karl J. Sprakel, Steinweg 18, both of 509 Leverkusen; Friedrich A. Muller, Osterriethweg 6, 5 Koln 50, all of Fed. Rep. of Germany

[21] Appl. No.: 898,897

[22] Filed: Apr. 21, 1978

Related U.S. Application Data

[63] Continuation of Ser. No. 741,776, Nov. 15, 1976, abandoned.

[30] Foreign Application Priority Data

Nov. 18, 1975 [DE] Fed. Rep. of Germany ..... 2551713

[51] Int. Cl.[2] ..... B24C 1/00

[52] U.S. Cl. ..... 51/319; 51/417; 51/321

[58] Field of Search ..... 51/319, 320, 321, 324, 51/410, 417, 418, 424, 425, 439; 134/9, 15, 16; 72/53, 56; 29/81 B

[56] References Cited

U.S. PATENT DOCUMENTS

| | | | |
|---|---|---|---|
| 2,605,596 | 8/1952 | Uhri | 51/321 |
| 2,680,938 | 6/1954 | Peterson | 51/431 X |
| 3,242,616 | 3/1966 | Haider | 51/426 |
| 3,545,996 | 12/1970 | Duncan | 51/319 X |
| 3,699,726 | 10/1972 | Turner | 51/319 |
| 3,994,097 | 11/1976 | Lamb | 51/321 |
| 4,100,782 | 7/1978 | Clay | 51/319 |

FOREIGN PATENT DOCUMENTS

| | | | |
|---|---|---|---|
| 2417580 | 11/1974 | Fed. Rep. of Germany | 51/424 |

*Primary Examiner*—Nicholas P. Godici
*Attorney, Agent, or Firm*—Michael J. Striker

[57] ABSTRACT

In a process for treating surfaces by means of a jet of liquid impinging on the latter at high velocity and with which, in particular, scouring or polishing solid particles, such as steel granules, corundum, sand, chalk or the like are admixed, the liquid jet is, after it has impinged on a surface to be treated, at least once returned to a surface to be treated for the purpose of exploiting the residual kinetic energy of the liquid. In a preferred form of the invention, the jet impinges on the surface at an angle of between 30° and 80° and is, after reflection from said surface, returned to the latter to impinge thereon at an angle of between 40° and 90°. In a particular embodiment of the invention, a sheet metal strip is guided along a loop and the jet impinges on a concave region within said loop.

4 Claims, 1 Drawing Figure

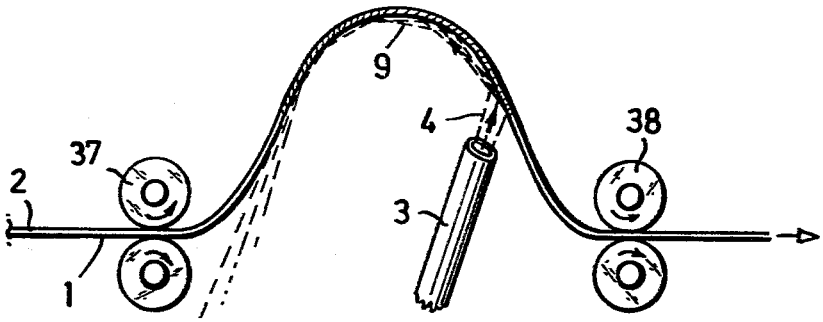
9
4
38
37
2
3
1

PROCESS FOR TREATING SURFACES BY MEANS OF A JET OF LIQUID

This is a continuation, of application Ser. No. 741,776, filed Nov. 15, 1976 now abandoned.

BACKGROUND AND SUMMARY

The invention relates to a process for treating surfaces by means of a jet of liquid impinging on the surface to be treated at high velocity and with which, in particular, scouring or polishing solid particles, such as steel granules, corundum, sand, chalk or the like, are admixed. This process serves the purpose of de-rusting, de-scaling and cleaning of iron and steel and also of the surface treatment of plastics. In this process, liquids, particularly water, are sprayed under very high pressure, e.g., of 200 to 600 atmospheres, from steel nozzles on to the surface to be treated. In the nozzle polishing or scouring solid particles are admixed with the liquid jet in a dry or a wet state. The process is applicable with advantage to the treatment of sheet metal, rolling profiles, tubes, wires and castings, and moreover also to the matting of plastic surfaces. The liquid jet impinging at high velocity on the surface to be treated tears dirt, scale and rust particles, oils adhering thereto and paint off this surface. In order to enhance the abrasive effect of the liquid jet, scouring or polishing solid particles are admixed therewith. When the liquid jet impinges on the surface to be treated, these solid particles pass through the liquid film and thus become effective.

In the known process, the energy consumption is relatively large. The object of the present invention is to provide a process and apparatus, with the aid of which improved energy utilization in the course of the above-described process is made possible.

In accordance with the invention, this object is fulfilled by returning the liquid jet after it has impinged on the surface to be treated, at least once to a surface to be treated for the purpose of exploiting the residual kinetic energy of the jet medium.

Advantageously, the liquid jet which is returned to the surface of the material to be created is, in the course of being so returned, somewhat displaced laterally, so that the regions of the surface which have been less intensely treated are treated by the returned jet. Thereby, it is possible not only to achieve improved energy utilization, but also greater regularity of treatment, so that the formation of stripes by reason of the spacing between the nozzles is eliminated to a large extent.

For the purpose of treating the surface of a sheet metal strip or a roller profile, the liquid jet is directed in a direction counter to the direction of movement of the material to be treated in such a way that it impinges on the surface to be treated at an angle of between 30° and 80°.

DRAWINGS

In the description which follows, a number of embodiments of the apparatus according to the invention will be explained in greater detail with reference to the drawings. The drawings show in:

The single FIGURE shows a diagrammatic representation of apparatus for treating sheet metal strips,

DESCRIPTION

As shown in the FIGURE, a liquid jet 4 is sprayed at high velocity on to the surface 1 to be treated of a sheet metal strip 2 by means of a nozzle 3.

As shown in the FIGURE, the liquid stream is displaced axially in the course of its diversion, so that the returned liquid stream 9 is applied to the surface 1 to be treated laterally of the primary liquid jet 4.

The jet 4 from the nozzle 3 is preferably a liquid jet with solid particles, adapted to treat the surface 1. The jet 4 may, be a compressed air jet; of a it may also contain solid particles.

The solid particles are selected from the group consisting of steel granoles, corundum, and chalk.

The sheet metal strip 2 is conducted in the form of a loop by means of rollers 37, 38 and other devices (not shown) so that a concave inner space is formed. The jet medium 4 is sprayed into this inner space with the aid of the nozzle 3. The jet medium impinges on the surface to be treated in such a way that, after reflection, it again impinges on the surface to be treated. After several reflections the jet medium flows along the surface and flows away below the roller 37. The flow along the concavely curved area of the sheet metal strip has the effect that the heavier solid particles are accelerated by a centrifugal effect on to the surface to be treated and flow therealong. For the purpose of descaling a sheet steel strip the loop formation may simultaneously also serve the purpose of tearing open the scale layers on the sheet metal strip.

We claim:

1. A process for treating a surface on sheet metal strip, said process comprising the steps of guiding a strip in the form of a loop;

discharging a jet of flowable material under a predetermined pressure onto a concave portion of the strip surface which is located in said loop and at an angle of between 30° and 80° therewith, at least a portion of said jet upon contacting the surface being subject to reflection from the surface and thus forming a stream directed away from said portion of the surface to be treated; and conducting the surface to be treated so as to form such a configuration thereof that said stream is intercepted at least once by another portion of the surface to be treated.

2. A process for treating a surface, comprising the steps of discharging onto one portion of the surface to be treated a jet of flowable material under a predetermined pressure, at least a portion of said jet upon contacting said one portion of the surface being reflected from said one portion and thus forming a stream directed away from said one portion of the surface; and conducting the surface to be treated so as to form such a configuration thereof that said stream is directly intercepted at least once by another portion of the surface right after said portion of the jet is reflected by said one portion of the surface.

3. A process as defined in claim 2, wherein said flowable material includes a liquid entrained with solid particles adapted to treat the surface.

4. A process as defined in claim 3, wherein said solid particles are selected from the group consisting of steel granules, corundum, sand and chalk.

* * * * *